United States Patent [19]

Kleber

[11] 4,303,459

[45] Dec. 1, 1981

[54] METHOD OF MAKING TEXTURED PATTERNS ON ORIGINALLY SMOOTH WEBS OF FABRICS, AND METHOD OF PARTIALLY PRINTING THE SAME

[76] Inventor: Kurt Kleber, Zum Mühlgraben 4, 6842 Bürstadt, Fed. Rep. of Germany

[21] Appl. No.: 98,058

[22] Filed: Nov. 28, 1979

[30] Foreign Application Priority Data

Dec. 4, 1978 [DE] Fed. Rep. of Germany ..... 2852346
Jul. 16, 1979 [DE] Fed. Rep. of Germany ..... 2928658

[51] Int. Cl.[3] ..... B29B 31/00; B29B 1/00; D05B 35/08; D06J 1/00

[52] U.S. Cl. ..... 156/227; 156/231; 156/230; 8/471; 223/28; 223/29

[58] Field of Search ..... 156/227, 231, 232, 237, 156/230; 428/181, 176, 103, 914; 8/471; 223/34, 29, 35, 28; 2/211; 38/44; 270/61 F, 62, 1.1, 22.1

[56] References Cited

U.S. PATENT DOCUMENTS

| | | | |
|---|---|---|---|
| 228,309 | 6/1880 | Brosemann | 223/29 |
| 235,067 | 12/1880 | Brown | 223/29 |
| 1,433,025 | 10/1922 | Murray et al. | 223/28 |
| 2,851,206 | 9/1958 | Guenther et al. | 223/28 |
| 3,193,844 | 7/1965 | Eng | 2/211 |
| 4,198,202 | 4/1980 | Kleber | 8/471 |

FOREIGN PATENT DOCUMENTS

| | | | |
|---|---|---|---|
| 2238854 | 7/1972 | Fed. Rep. of Germany | 38/44 |

*Primary Examiner*—Edward C. Kimlin
*Assistant Examiner*—L. Falasco

[57] ABSTRACT

The invention relates to a method for making textured patterns on originally smooth web of fabric which was subjected to a mechanical pleating treatment, i.e., which was provided with upright or flat permanently fixed pleats in regular or irregular distribution.

For this purpose, the mechanically pleated web of material is continuously heated and the pleated pleats are deformed simultaneously or subsequently to the heating either by tensioning the web of fabric or by at least partial compression of the pleats. The deformation is then fixed by cooling the web of fabric. In addition, the textured fabric may be partially printed in the transfer-printing method in a color and/or pattern deviating from the base material within the areas of the textured web of fabric, in that a web of thermal printing paper is pressed against the web of fabric in the desired color or the desired pattern during the heating step.

6 Claims, 11 Drawing Figures

FIG. 1
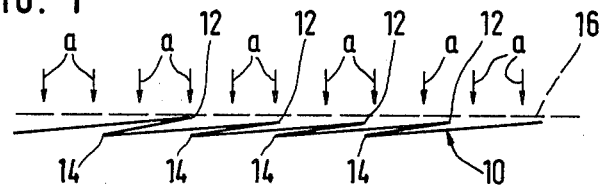
FIG. 2
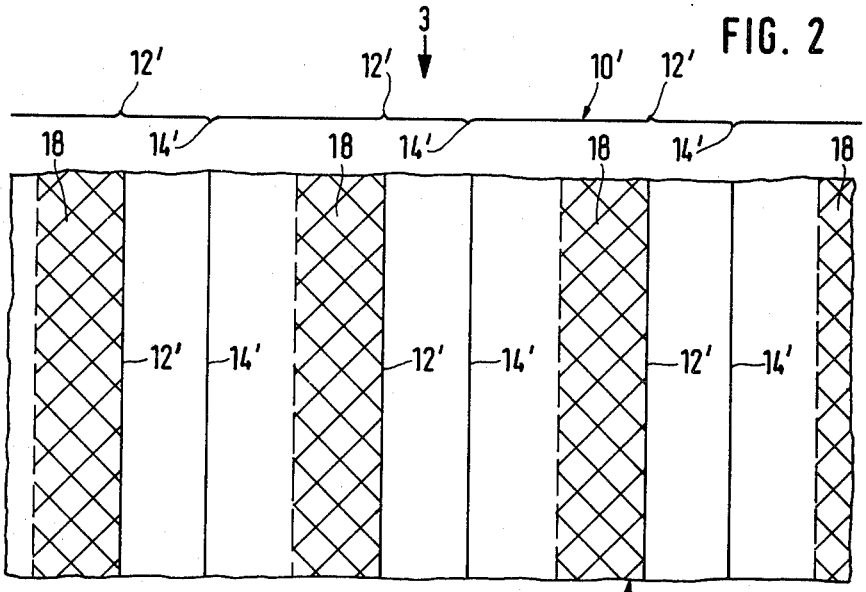
FIG. 3
FIG. 4
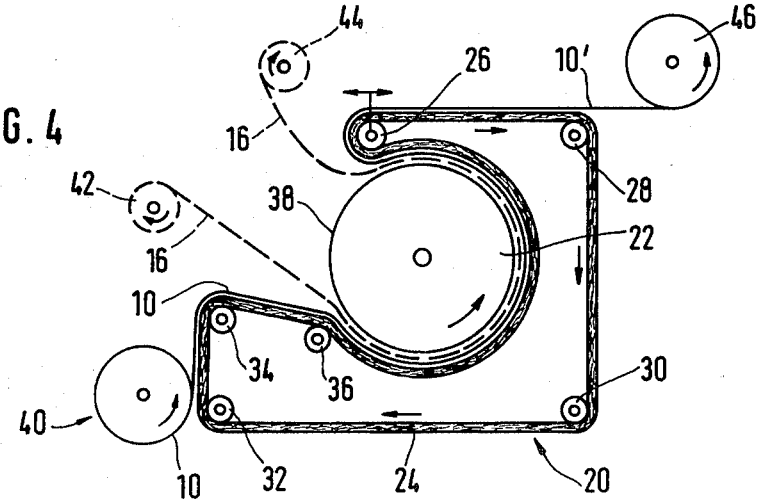

METHOD OF MAKING TEXTURED PATTERNS ON ORIGINALLY SMOOTH WEBS OF FABRICS, AND METHOD OF PARTIALLY PRINTING THE SAME

BACKGROUND OF THE INVENTION

The invention relates to a method for making textured patterns on webs of fabrics, wherein the originally smooth web of fabric is first subjected to a mechanical pleating treatment.

In ladies' fashion pleated fabrics are constantly used to a lesser or greater extent—depending on the ever changing fashion trends—for further processing into skirts, dresses, blouses, etc. Mechanically pleated fabrics are used in particular, with fabrics being introduced lately—in addition to the so-called flat and upright pleats—which are provided with pleat patterns of different types instead of the evenly wide or deep pleats which run across the total width of a web of fabric. For example, such fabrics may be provided with wave-shaped pleats in addition to a plurality of small straight running pleats and in an alternating fashion wave-like pleats with adjacent straight running pleats, or adjacent to a short, small row of pleats, a similar row of pleats may be provided however offset by the half width of the row of pleats, etc. Such fabrics which may be called "irregularly pleated" are known, as well as the type and manner of their manufacture, whereby a plurality of further possible arrangements of irregular pleats exist and may be made in addition to the aforementioned pleat patterns. In comparison to clothes made from smooth fabrics the use of pleated fabrics of the aforementioned type has a substantially higher fabric consumption, depending on the type of pleats of the fabric to be processed, which naturally has a cost increasing effect on the clothes made from pleated fabrics. Furthermore, the processing of pleated fabrics into clothes is rather difficult and expensive, since constant care has to be taken from the initial cutting of the pleated fabric to the subsequent processing steps that the pattern of the pleats corresponds to the design, and that during the sewing of cut cloth pieces no tension is accidentally transferred to the fabric which would draw the pleats apart with respect to the intended design. In order to avoid this it is required to process a thin paper web which is placed beneath the web of fabric, at least when processing thin mechanically pleated fabrics.

It is, therefore, an object of the invention to provide a method for making webs of fabric which are texture-like patterned in the fabric material itself, in comparison to pleated fabrics, but which may be processed with a lesser consumption of fabric when making clothes and without the above-mentioned difficulties.

Furthermore, the inventive method should permit the partial printing of the web of fabrics with a color and/or a pattern which deviates from the base color, within the generated fabric texture.

Based on a web of fabric which has been subjected to a mechanical pleating treatment, this object of the invention is achieved by heating the mechanically pleated web of fabric and by deforming the heating pleats, whereafter the deformation of the pleats is fixed by cooling the web of fabric. Thus, the texture generated in the web of fabric is formed by the pattern of the deformed pleats. The deformation of the pleats is done differently, depending on the type of the initial pleat, however, in any case essentially in such a manner that at least a part of the fabric material which has been folded into the pleats is formed back into the plane of the web of fabric.

The partial printing of the web of fabric so that the printed areas are aligned with the textured pattern is carried out in a further embodiment of the invention wherein a web of thermal printing paper is fed onto the mechanically pleated web of fabric before the web of fabric is heated, wherein both webs are pressed together in a superimposed position while simultaneously heating the same to the temperature required for transfer of the ink and/or the pattern of the thermal printing paper onto the web of fabric, and that the web of thermal printing paper is removed after the pattern has been transferred onto the web of fabric. Advantageously, the fabric which is heated during the transfer printing process is immediately deformed, so as to eliminate an otherwise required reheating during the texturing process.

In fabrics having flat pleats the inventive method is preferably carried out in such a manner that the mechanically pleated web of fabric is so tensioned in the heated state that the pleats are substantially smoothed, whereupon the thus tensioned fabric is wound into a roll and is cooled in the wound-up state. Since the cooling of the web of fabric occurs in the wound-up state with pulled-apart pleats the pleats do not return to their original position during the subsequent processing but the fabric remains substantially smooth, while the pleat edges which were generated due to the heating and pressing effect during the initial pleating process remain as edge patterns which texture the web of fabric in the desired manner.

In the simplest manner the method may be carried out in that the mechanically pleated web of fabric which is still in a heated state from the pleat treatment is tensioned and wound up immediately following the heat treatment. Alternatively, the method may be carried out starting with a mechanically pleated web of fabric which is cooled and is present in form of a roll and in which the web of fabric is continuously drawn off from the roll and heated, tensioned again and then wound up again. For heating and tensioning and the subsequent winding up of the web of fabric a suitable calender having a heated roller may be used at which a winding up device with an adjustable winding up speed control is provided.

In this mode of the method it is also possible to print the web of fabric during the heating process in the transfer printing method in that the web of thermal printing paper is fed onto the mechanically pleated web of fabric which is drawn off from the roll before the continuous heating. The two webs are then pressed together in a superimposed position while simultaneously heating the same to the temperature required for transfer of the ink and/or the pattern of the thermal printing paper onto the web of fabric, and the web of thermal printing paper is removed from the web of fabric before the subsequent tensioning and winding up of the web of fabric. For the technical operation the aforementioned calender may be used again, but it must be provided with an additional receiving means for the thermal printing paper which has to be placed on the upper side of the pleated web of fabric to be printed, and should be provided with a winding up means for the thermal printing paper which has been used and which has to be separated from the web of fabric after the printing process.

If the inventive method is to be used in a web of fabric wherein first by mechanical means low upright pleats were pleated after being covered with an upper and lower web of paper, whereupon the pleated web of fabric is wound up and wherein the pleats were permanently fixed by a subsequent heat treatment of the roll, the inventive method provides that the web of fabric with the upright pleats and with the upper paper web removed, is drawn off from the roll and a web of thermal printing paper is placed onto it free upperside. Thereafter, the upright pleats of the web of fabric are partially compressed and engage with the compressed areas the web of thermal printing paper, while heat energy is applied to the rear side of the web of thermal printing paper which is facing away from the web of fabric, thus transferring the ink and/or the pattern of the thermal printing paper to the adjacent areas of the web of fabric. The thermal printing paper is subsequently separated from the web of fabric. Surprisingly it has been shown that during the partial compression of the upright pleated pleats no pleat squeezing occurs and that the compressed areas at which the thermal printing paper engages can be printed with a clear color print, while the width of the printed areas of the pleats may even be changed to a certain extent by varying the counter pressure of the thermal printing paper, so that more or less wide strip-like areas of the pleats may be printed, which results in particularly interesting effects when using monochromatic or multi-colored patterned thermal printing paper. Due to the heat applied during the printing process onto the areas to be printed the initially sharp edged fixed upright pleats are somewhat rounded off. Therefore, the texturing of the printed fabric is also referred to as "wave pleats."

When carrying out the aforementioned method preferably the upper web of paper is removed from the web of fabric before the heat treatment for the purpose of permanently fixing the upright pleats, and during the subsequent winding up operation of the pleated web of fabric a smooth following web of paper, i.e., one that does not engage the sides of the pleated upright pleats, is rolled into the web of fabric. The following paper web is again removed before applying the web of thermal printing paper.

A rational or economical mode of operation in the continuous pass-through operation is obtained if the web of fabric which is provided with the upright pleats and the web of thermal printing paper placed thereon is continuously fed onto the circumferential face of a rotating heated pressure roller, in such a way that the rear side of the web of thermal printing paper engages the pressure roller. The engaged webs are pressed against the web of thermal printing paper by a web of felt-like material which rest against the rear side of the web of fabric provided with the lower web of paper. The web of felt-like material winds around the pressure roller in a predetermined angle range and follows in this angle range with the angle speed of the pressure roller. The heat retaining web of felt which runs in the pressure range with the angle speed of the printing roller prevents a displacement of the web of fabric relative to the web of thermal printing paper, so that a clear print is generated. By changing the (relatively low) tension of the felt web the above-mentioned change in the width of the printed area may be adjusted.

As a material for the lower paper advantageously a web of creped paper is used which is a stiffer paper when compared with the paper which is used in the pure upright pleating. The crepe of the paper assures that no displacements occur between the web of felt and the lower paper web, while the increased stiffness permits generating the required minimum counter pressure of the web of paper onto the thermal printing paper so as to obtain a clear transfer print without the occurrence of a pleat squeeze.

In an advantageous further development of the invention the web of fabric with the provided upright pleats is tensioned in the longitudinal direction of the web prior to placement of the web of thermal paper, so that the upright pleats are somewhat pulled apart with respect to the non-tensioned state.

The finished printed web of fabric has lower, flatter waves when compared with a printing process without such an additional tensioning.

A similar effect may also be generated by separating the pleated web of fabric immediately from the lower web of paper after the printing and the removal of the web of thermal printing paper, and by winding up the same into a roll while still warm, under such a longitudinal tension that the wave-like pleats remaining in the web of fabric are smoothed in the wound-up state. A piece of fabric which is drawn off from this roll assumes again the wave shape. However, these waves are lower and wider when compared to a web of fabric which was wound up after the printing together with the lower paper in a non-tensioned condition. The consumption of fabric which depends on the pleat depth is considerably reduced when comparing the processing of pleated fabric with the processing of non-pleated fabric. In a borderline situation, i.e., when very flat waves are obtained the fabric consumption almost equals that of non-pleated fabrics.

The invention is explained in more detail in the following description and in conjunction with the drawing, in which:

FIG. 1 is a schematic side view of a short section of a web of fabric provided mechanically with a flat pleat in known manner, and on which a section of a thermal printing paper web is placed;

FIG. 2 is a side view of the segment of the web of fabric of FIG. 1 after the inventive method has been carried out;

FIG. 3 is a plan view of the web of fabric segment shown in FIG. 2 which is additionally printed, by transfer printing method, with a strip-like printed pattern aligned with the pleated edges obtained in accordance with the invention;

FIG. 4 is a schematic side view of a calender used for carrying out the inventive method;

Figure 5:
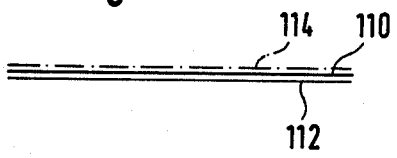
FIG. 5 is a schematic side view of a short segment of a web of fabric which is covered with an upper and lower paper web and is to be textured and printed in the inventive manner.

FIG. 1 shows a web of fabric segment 10 which, in known manner, is provided with flat pleats, i.e., flatly superimposed laterally offset pleats. In the method according to the invention, the segment is further processed into a substantially smooth web of fabric segment 10′ which, however, is provided in the area of pleat edges 12 and 14 of the original flat pleat with parallel pleat edges 12′ and 14′, as schematically shown in FIGS. 2 and 3. A thermal printing paper segment 16 is placed on the web of fabric segment 10, whereby the arrows "a" pointing on the thermal printing paper segment indicate how the ink and/or the pattern of the thermal printing paper may be transferred onto the web of fabric segment 10 by a simultaneous heating and pressure effect. Only the sides facing the thermal printing paper 16 are being printed, but not the doubly-folded pleats of the web of paper segment 10. FIG. 3 shows the printed areas 18 of web of fabric segment 10′, illustrated by cross hatching.

The carrying out of the inventive method will now be explained in conjunction with FIG. 4 which schematically shows a calender 20 with a large rotatably driven steel roller 22 the circumferential face of which is heatable to the temperature required for carrying out the inventive method by means of a heated oil filling. An endless belt 24 made of heat-retaining felt engages roller 22 and is fed by deflection rollers 26, 28, 30, 32, 34 and 36 in such a manner that it loops the circumferential face 38 of roller 22 over an angle of more than 180°. Preferably, the deflection roller 26 is not mounted stationarily but slideably in the calender frame (not shown), so that by changing the pressure in an air pressure cylinder (also not shown) at the fulcrum of the deflection roller 26 the tension may be changed with which the web of felt 24 is pressed against the circumferential face 38 of roller 22. The flat pleated web of fabric 10 which is wound up on a supply roll 40 is drawn off from this supply roll 40 and is fed into the area of the circumferential face 38 of roller 22 looped by web of felt 24. The thermal printing paper 16 which is drawn off from a roller 42 is fed between the circumferential face 38 and the web of fabric 10. Due to the pressure which is exerted by the web of felt 24 onto the web of fabric and the web of thermal printing paper 16 thereon, the web of paper 10, the web of thermal printing paper 16 and the web of felt 24 move with the circumferential speed which corresponds to the speed of roller 22 when roller 22 is driven, without causing any displacements between the individual webs. Heating of roller 22 accomplishes on one hand transfer printing from thermal printing paper 16 onto the web of fabric and on the other hand the web of fabric is heated. The discharging thermal printing paper is wound up onto roller 44, while the printed and heated web of fabric is wound up onto a roller 46 which is deliberately driven with a higher speed than the circumferential speed of roller 22, whereby the heated web of fabric is tensioned in such a manner that the pleats are substantially pulled smooth. Therefore, the web of fabric 10′ is wound up on roller 46 without pleats.

When the web of fabric material 10′ cools in this smooth-pulled, wound-up form the substantially smooth web of fabric 10′ is obtained as shown in FIGS. 2 and 3, on which however, the original pleats 12 and 14 show in a textured manner in form of pleat edges 12′ and 14′.

If a web of fabric is to be provided with a textured pattern made of pleat edges in accordance with the invention, the thermal printing paper 16 may be omitted.

It should be mentioned that the described method is not limited to mechanically made flat pleats, but may also be used in a corresponding manner for webs of fabric which are provided with so-called upright pleats or irregularly pleated webs of fabric, whereby in particular in the latter mentioned irregular pleated fabrics an interesting effect is obtained when the fabrics are printed in the transfer print method, which will be described, before drawing apart the pleats.

When using webs of fabrics as the base product which are provided with upright pleats, the inventive method may be carried out in the following manner. Since the mechanical manufacturing of upright pleats is known, as well as the pleating machines used for this purpose, it should suffice to briefly illuminate a few essential peculiarities for the subsequent deforming and printing operations.

Figure 6:
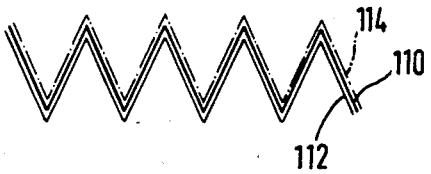
FIG. 6 is a side view of the web of fabric shown in FIG. 5 after the mechanical placing of the upright pleats.

A lower web of paper 112 and an upper web of paper 114 is placed onto the web of fabric 110 which is to be pleated and later to be deformed, in the manner schematically shown in FIG. 5. The three-tiered web 112, 110, 114 is pleated in a known pleating machine into an upright pleated shape, as shown in FIG. 6. The fixing of the pleated shape is carried out in a heating box or an auto-clave, for which purpose the pleated web of fabric is first wound up. Preferably, the upper paper 114 is not rolled up with the pleated web of fabric, but instead a smooth following paper (not shown) is wound up therewith for separating the pleated layers.

Figure 7:
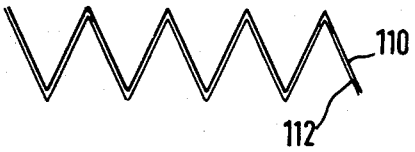
FIG. 7 is a side view corresponding to FIG. 6, in which the upper paper is removed.
Figure 8:
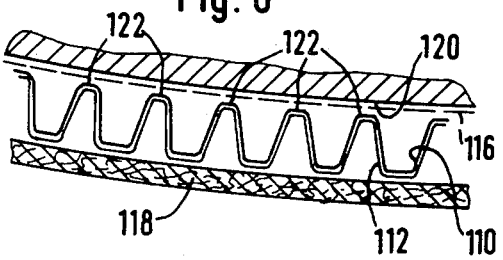
FIG. 8 is a side view of the lower paper and web of fabric shown in FIG. 7, during the deforming and transfer printing process.
Figure 9:
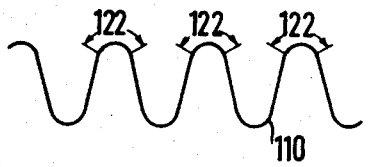
FIG. 9 is a side view of a printed finished web of fabric with relatively tight wave-like pleats, in accordance with the inventive method.
Figure 10:
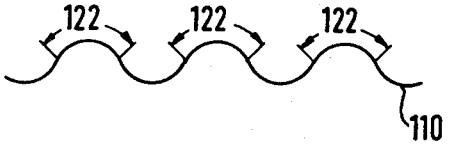
FIG. 10 is a side view of a finished printed web of fabric with relatively wide drawn-apart wave-shaped pleats.

This roll is then placed in an upright position into the heating or steam box and is retained therein for the required treatment duration. After cooling of the roll subsequent to removal from the heating box, the upright pleats are fixed, as shown in FIG. 7. For the subsequent treatment the web of fabric 110 together with the lower paper 112 are again drawn off, with the following paper which is not required any longer, being again removed. The thermal printing paper 116 (FIG. 8) is placed on the free upper side of the web of fabric 110. The lower side of the web of material which is covered with lower paper 112 rests on a belt 118 made of a heat resistant felt-like material and a pressure is exerted onto the rear side of the thermal printing paper 116 by means of a schematically shown heated face 120 of FIG. 8, so that the pleats of the composite web 110, 112, deform in the manner shown in FIG. 8. As can be seen, strip-like areas 122 on both sides of the initial front edges of the upright pleats do engage with their faces the thermal printing paper 116. The printing pattern of the thermal printing paper is transfered to areas 122 by the heat emitted from the surface formed by the circumferential face of a heated pressure roller 120, for example. Depending on the carrying out of the printing process the schematically shown wave-pleated webs of fabric 110 of FIGS. 9 and 10 are created with smaller and deeper or wider and lower wavy pleats. As can be seen from the drawings the printed areas 122 extend over the rounded-off wave crests, while the intermediate disposed wave bottoms remain unprinted. The thus produced printed, wave-pleated webs of fabric represent a fashionable interesting base product for manufacturing dresses, skirts, blouses, etc.

Figure 11:
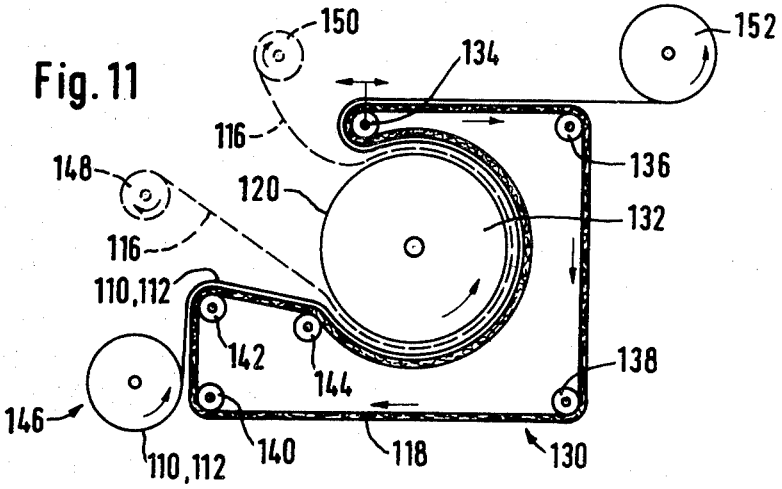
FIG. 11 is a schematic side view of a calender for carrying out the inventive method explained in conjunction with FIGS. 5 to 10.

FIG. 11 shows schematically a calender 130 for carrying out the aforementioned described method. This calender consists of a large rotatably driven steel pressure roller 132, the circumferential face of which serves as the pressure face 120 and is brought to the required temperature by a heated oil filling. The felt web 118 is in form of an endless belt which is guided by deflection rollers 134, 136, 138, 140, 142 and 144 in such a manner that it loops the circumferential face 120 of pressure roller 132 over an angle of more than 180°. The deflection roller 134 is preferably not mounted stationary but slideably in the calender frame (not shown), so that by changing the pressure in an air pressure cylinder (also not shown) at the fulcrum of the deflection roller 134 the tension may be changed with which the web of felt 118 is pressed against the circumferential face 120 of pressure roller 132.

The composite upright pleated web 110, 112 which is composed of the web of fabric 110 and the lower web of paper 112 is drawn off from the supply roller 146 and is fed to the area of the circumferential face 120 of pressure roller 132 which is looped by the web of felt 118. The thermal printing paper 116 which is drawn off from roller 148 is fed between the circumferential face 120 and the web 110, 112. Since the web of felt 118 moves through the looping area with the same angle speed as pressure roller 132, no relative displacement occurs between the thermal paper with respect to web 110, 112 in the print area, so that a clear print is obtained. The discharged thermal printing paper 116 is wound up on roller 150, while the printed web 110, 112 is wound up on roller 152. The printed web of fabric cools off on the path between the discharge from the print slot and roller 152. This cooling may be enhanced by an additional blowing of cooling air. The lower paper may be removed before winding up on roller 152, or it may be wound up therewith.

It should be noted that the composite web which is composed of the web of fabric 110 and the lower web of paper 112 is shown in the drawing as a plane web, so as to simplify the drawing. In reality, however, when entering this web has the shape shown in FIG. 7, with sharply edged upright pleats, while it has the waved shape after discharge from the pressure slot, as shown in FIGS. 9 and 10.

In case that the flatter waves are to be manufactured as shown in FIG. 10, roller 146 may be provided with an adjustable brake, so that the web 110, 112 must be drawn off from roller 146 against the braking force, whereby the upright pleats are drawn apart. The winding up onto roller 152 takes place under tension, so that the wave-pleated printed web of fabric is smoothly wound up on the roller, thus also enhancing the creation of flatter wave pleats. Such webs of fabrics with flatter waves have the advantage of a lesser fabric consumption in contrast to webs of fabrics with the deeper "wave pleat," which in a borderline situation, i.e., with very flat waves, is almost equal to the consumption of non-pleated fabrics.

On the other hand, the fashionable effect which is obtained in clothes made of fabric with deep-wave pleats is increased by the movements of the person wearing the clothes, because due to the tensioning or relaxing of individual fabric portions the unprinted portions in the pleat bottom are visible to a greater of lesser degree in contrast to fabrics with flatter pleated waves.

I claim:

1. A method of making textured patterns on an originally smooth web of fabric, comprising: covering the smooth web of fabric with an upper and lower web of paper subjecting the webs to such a mechanical pleating treatment so as to obtain fixed upright pleats regularly or irregularly distributed over the web of fabric, winding up completed webs in a roll, continuously heating the thus mechanically pleated web of fabric, removing the upper web of paper and withdrawing the web of fabric with the upright pleats and lower web of paper from the roll, deforming the previously permanently fixed pleated pleats, placing a web of thermal printing paper on the free upper side of the web of fabric, compressing the webs such that the upright pleats of the web of fabric are partially compressed and engage with the web of thermal printing paper, applying heat to the rear side of the web of thermal printing paper which is facing away from the web of fabric, thus transferring ink and/or a pattern of the thermal printing paper to the adjacent areas of the web of fabric and finally fixing the deformation of the pleats by cooling the web of fabric.

2. A method according to claim 1, wherein the upper web of paper is removed from the web of fabric before the heat treatment for the purpose of permanently fixing the upright pleats, wherein during the subsequent winding up of the pleated web of fabric a smooth following web of paper is rolled into the web of fabric, and wherein the following paper web is again removed before placing the web of thermal printing paper onto the web of fabric.

3. A method according to claim 1, wherein the web of fabric provided with the upright pleats and the web of thermal printing paper placed thereon is continuously fed onto a circumferential face of a rotating heated pressure roller, such that the rear side of the web of thermal printing paper engages the pressure roller, and pressing the engaged webs against the web of thermal printing paper, with the rear side of the web of fabric engaged by the lower web of paper, by means of a following web of felt-like material which winds around the pressure roller over a predetermined angle range and follows this angle range with the angle speed of the pressure roller.

4. A method according to claim 3, wherein said lower paper web is a web of creped, relatively stiff paper.

5. A method according to claim 1, wherein the web of fabric with the provided upright pleats is tensioned in the longitudinal direction of the web prior to placement of the web of thermal printing paper thereon, so that the upright pleats are somewhat pulled apart with respect to their non-tensioned state.

6. A method according to claim 1, wherein the pleated web of fabric is immediately separated from the lower web of paper after the printing and the removal of the web of thermal printing paper, and is wound up into a roll under such a longitudinal tension that wave-like pleats remaining in the web of fabric are smoothed in the wound up state of the web of fabric.

* * * * *